US006540812B2

(12) United States Patent
Farmer et al.

(10) Patent No.: US 6,540,812 B2
(45) Date of Patent: Apr. 1, 2003

(54) METHOD AND SYSTEM FOR IMPROVED RAPPER CONTROL

(75) Inventors: Terry L. Farmer, Kearney, MO (US); David F. Johnston, Yorktown, VA (US); Sven Richter, Newport News, VA (US); Michael M. Mahler, Hayes, VA (US)

(73) Assignee: BHA Group Holdings, Inc., Kansas City, MO (US)

( * ) Notice: Subject to any disclaimer, the term of this patent is extended or adjusted under 35 U.S.C. 154(b) by 0 days.

(21) Appl. No.: 09/900,082

(22) Filed: Jul. 6, 2001

(65) Prior Publication Data

US 2003/0010203 A1 Jan. 16, 2003

(51) Int. Cl.[7] ..... B03C 3/68; B03C 3/76

(52) U.S. Cl. ..... 95/2; 95/6; 95/76; 96/18; 96/22; 96/32; 96/33; 323/903; 700/273; 700/275

(58) Field of Search ..... 95/2, 6, 7, 74, 95/76; 96/18, 32, 33, 22–24; 323/903; 700/273, 275

(56) References Cited

U.S. PATENT DOCUMENTS 3,469,371 A * 9/1969 Gelfand ..... 96/24
3,893,828 A * 7/1975 Archer ..... 96/32 X
4,035,165 A 7/1977 Archer ..... 96/25
4,086,646 A * 4/1978 Lanese ..... 96/32 X
4,221,573 A 9/1980 Hankins ..... 96/35
4,255,775 A 3/1981 Andrews ..... 96/25
4,285,024 A 8/1981 Andrews ..... 96/25
4,624,685 A * 11/1986 Lueckenotte et al. ... 323/903 X
4,928,456 A 5/1990 Del Gatto et al. ..... 364/502 X
5,015,267 A 5/1991 Del Gatto et al. ..... 95/2
5,114,442 A 5/1992 Artz ..... 323/903 X
5,173,867 A 12/1992 Johnston et al. ..... 364/550

* cited by examiner

*Primary Examiner*—Richard L. Chiesa
(74) *Attorney, Agent, or Firm*—Shook, Hardy & Bacon L.L.P.

(57) ABSTRACT

An improved method and system is provided to control the rapping process used to clean the internal collection plates and discharge electrodes of electrostatic precipitators. The system obtains the performance characteristics of a first rapper and calculates a rapper lift value. The system then obtains performance characteristic data from two or more additional rappers and calculates rapper lift values for each of the rappers. Finally, the system compares the rapper lift value of each additional rapper and adjusts its performance characteristics so that it substantially approximates the performance characteristics of the first rapper.

21 Claims, 2 Drawing Sheets

METHOD AND SYSTEM FOR IMPROVED RAPPER CONTROL

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

This invention relates generally to electrostatic precipitators for air pollution control and, more specifically, concerns the control of the rapping process used to clean the internal collection plates and discharge electrodes of electrostatic precipitators.

BACKGROUND OF THE INVENTION

Continuous emphasis on environmental quality has resulted in increasingly strenuous regulatory controls on industrial emissions. One technique which has proven highly effective in controlling air pollution has been the removal of undesirable particulate matter from a gas stream by electrostatic precipitation. An electrostatic precipitator is an air pollution control device designed to electrically charge and collect particulates generated from industrial processes such as those occurring in cement plants, pulp and paper mills and utilities. Particulate is negatively charged. These negatively charged particles are attracted to, and collected by, positively charged metal plates. The cleaned process gas may then be further processed or safely discharged to the atmosphere.

During continuous operation of an electrostatic precipitator, the collector plates, electrodes and other precipitator internal components must be periodically cleaned to remove the dust build-up which accumulates on these surfaces. The cleaning mechanism typically consists of a mechanical rapper. An electronic rapper controller determines the sequence, intensity, and duration of rapping. Once the particulate is dislodged from the plates, it falls into collection hoppers at the bottom of the precipitator.

Rappers are electro-mechanical devices that are used to mechanically dislodge collected particulate/materials within an electrostatic precipitator, electronic filter or dust collector (hereafter referred to as ESP) by applying direct current (DC) energization to the rapper. In general, a rapper consists of a hammer that mechanically strikes an anvil. The anvil is mechanically connected to the internal components of the ESP, such as the discharge electrodes, collecting plates, gas distribution devices or any other component cleaned by the rapper. Striking the rapper shaft or anvil with the hammer transmits mechanical forces to these components to dislodge collected materials. Several rapper variations exist which may be employed in the cleaning process.

One rapper variation consists of a cylindrical hammer or plunger and solenoid coil. The hammer rests on the rapper shaft or anvil. When the solenoid coil is energized with a DC voltage the resulting electromagnetic force overcomes the force of gravity and lifts the hammer vertically to a height that is determined by the amplitude and length of time of the energization. When the energization is terminated, the electromagnetic field is removed and the hammer drops due to gravitational forces and strikes the anvil. The hammer then rests on the anvil until the next energization.

Another rapper variation places a spring behind the cylindrical hammer. When the solenoid coil is energized with a DC voltage the resulting electromagnetic force will overcome the force of gravity and lift the hammer vertically compressing the spring against the rapper assembly. The height and spring compression are determined by the amplitude and length of time of the energization. When the energization is terminated the hammer strikes the anvil with a force that is comprised of gravitational force plus the spring expansion.

Another rapper variation places a spring behind the cylindrical hammer. This spring is connected to the hammer and holds it above the anvil. When the solenoid coil is energized with a DC voltage the resulting electromagnetic force will overcome the force of the spring and accelerate the hammer downward to strike the anvil. When the energization is terminated, the hammer is returned to position by the spring.

In practice, numerous operational problems associated with the cleaning process may be experienced. Excessive rapping results in the particulate billowing from the plate into the gas stream where it is re-entrained in gas flow and must be recaptured. Otherwise, the re-entrained dust will be discharged from the exhaust stack, resulting in unacceptable emissions into the atmosphere. Insufficient rapping prevents the particulate from falling from the surfaces to be cleaned. In either case, collection efficiency of the precipitator is reduced which reduces the gas volumes that can be treated by the precipitator. In most industrial applications there is a direct correlation between precipitator capacity and production capacity. Therefore, there are significant monetary benefits to be derived from maximizing rapper efficiency. Also, grossly inefficient precipitators which allow an excessive amount of particulate emissions into the atmosphere can prompt the Environmental Protection Agency to shut a particular process down indefinitely.

Rapper control has been typically limited to manually controlling and adjusting the current level to an entire group of rappers, rather than individual rapper control. However, rappers in different locations within the group may operate more efficiently with different current levels. Because the number of rapper groups, as well as the number of rappers within each group, may vary and prior art rapper control only allows for intensity adjustment of an entire group, a compromise in control standards therefore prevails. The result is often rapper inefficiencies that reduce precipitator and production capacity as well as increase emissions levels.

Newer rapper control systems that allow for adjusting individual rappers also experience inefficiencies. These systems fail to take into account line losses and impedance at the rapper coil when making adjustments to the peak current level of an individual rapper. Using an incorrect peak current results in rapper inefficiencies that include reduced precipitator functionality and increased emission level.

Additionally, and important to the present invention, the intensity of the rap and the corresponding cleaning forces imparted to the internal components of the ESP are determined by the height of the hammer is lifted. This is known as the rapper lift. If the hammer is not lifted high enough, then there will be insufficient cleaning. Conversely, if the hammer is lifted too high, then damage to the internal components of the ESP will result. Therefore, it is desirable to closely regulate rapper lift to provide thorough cleaning without damage. It is an object of this invention to provide a system to closely and accurately regulate the rapper lift.

It is well known in the prior art that rapper lift can be measured by a number of conventional methods. For example, a Linear Variable Displacement Transducer (LVDT) can be used to accurately measure rapper lift. U.S. Pat. No. 5,114,442, Artz, teaches that a kinetic energy sensor can be used to measure rapper energy output. Each of these methods has a disadvantage; they require significantly more equipment and wiring than normally found on the conventional rapper control. In some cases, the sensors and wiring may cost more than the rappers, making the application of these methods impractical. U.S. Pat. No. 5,173,867, Johnston et al., discloses a multiple rapper control which has a current detecting means bi-directionally connected to a computer to sense and measure the peak electrical input current to each rapper. It is an object of this invention to provide a system to closely and accurately regulate rapper lift using such a multiple rapper control without requiring additional wiring or sensors.

It is well known in the prior art that the rapper lift is not consistent for a given rapper energization. U.S. Pat. No. 5,114,442, Artz, teaches that an ambient temperature change will cause a change in rapper lift. Artz discloses a system to compensate for temperature changes by adjusting the rapper energization in response to a temperature sensor. This system has a number of disadvantages, not the least of which is the use of temperature sensors or a plurality of temperature sensors to infer a change in rapper characteristics. It is an object of this invention to directly use the individual rapper characteristics to closely and accurately regulate the rapper lift without additional sensors or wiring.

It is well known in the prior art that the rapper lift is not consistent for a given rapper placement on the ESP relative to the rapper control. Rappers may be physically close to the rapper control or some distance away. This has the effect of inserting the impedance of the connecting wire and connections in series with the rapper coil. Although the magnitude of this impedance is not great, it has a substantial effect on the resultant rapper lift. The effect of rapper placement and wiring length on rapper lift was tested using a rapper of the type manufactured by BHA Group Holdings, Inc. of Kansas City, Mo. The rapper is a 120VDC electromagnetic gravity impact style, with a 20-pound hammer. The results are shown in Table 1.

TABLE 1

The Effect of Rapper Placement and Wiring Length on Rapper Lift.

| Duration or Intensity Setting (Half Cycles On) | Length of Wiring (feet) | Wiring Impedance (ohms) | Rapper Lift (inches) | Error In Rapper Lift (percent) |
|---|---|---|---|---|
| 14.0 | 0 | 0.0 | 5.76 | Baseline |
| 14.0 | 145 | .5 | 3.36 | −42 |
| 14.0 | 291 | 1.0 | 1.82 | −68 |
| 14.0 | 436 | 1.5 | 1.06 | −82 |
| 14.0 | 581 | 2.0 | 0.48 | −92 |

In order to obtain a baseline for comparison, the rapper was tested with an intensity or duration setting of 14.0 half cycles. The rapper was physically close to the rapper control which provided an impedance of zero ohms between the rapper control and the rapper's coil. This yielded a baseline for comparison of 5.76 inches of rapper lift as shown in Table 1. Keeping the same intensity or duration setting and physically moving the rapper away from the rapper control yielded the remaining results shown in Table 1. Note that the distance is length of wiring, not distance from the rapper control, because it is the length of wiring that adds impedance. The error in rapper lift becomes large with small additions of impedance. It is an object of this invention to provide a system, which will closely and accurately regulate rapper lift independent of wiring impedance or rapper placement on the ESP.

It is well known in the prior art that the rapper lift is affected by the magnitude of the rapper current. U.S. Pat. No. 4,285,024, Andrews, teaches that hammer displacement is indicated by integrating the rapper current over the time the rapper energization pulse is applied. Since accurately measuring rapper lift is fundamental to accomplishing the objectives of this invention, this technique was tested using a rapper of the type manufactured by BHA Group Holdings, Inc. of Kansas City, Mo. The rapper is a 120VDC electromagnetic gravity impact style, with a 20-pound hammer. The results are shown in Table 2.

TABLE 2

Prior Art Rapper Lift Indicator Based Upon Integrating the Current Over Time.
Note: Measured with series impedance as indicated.

| Rapper Lift (inches) | Impedance (ohms) | Integration Over Time (Amp Seconds) | Error In Amp Seconds (percent) |
|---|---|---|---|
| 5.76 | 0.0 | 1.64 | Baseline |
| 5.76 | 0.5 | 1.89 | 15 |
| 5.76 | 1.0 | 2.21 | 35 |
| 5.76 | 1.5 | 2.57 | 57 |
| 5.76 | 2.0 | 2.93 | 79 |

In order to obtain a baseline for comparison, the rapper was tested with a rapper lift of 5.76 inches. The rapper was physically close to the rapper control, thus providing an impedance of zero ohms between the rapper control and the rapper's coil. The current was integrated over time, which yielded a baseline for comparison of 1.64 amp seconds. Keeping the same rapper lift and physically moving the rapper away from the rapper control, yielded the results shown in Table 2. Again, the distance is length of wiring, not distance from the rapper control, because it is the length of wiring that adds impedance. If there had been no error, there would have been a reading of 1.64 amp seconds for every case. The error in rapper lift measurement by integrating the current over time is significant and this method will not provide a.measurement accurate enough to accomplish the objectives of this invention. It is therefore an object of this invention to provide a system to more accurately measure rapper lift than prior art systems that can be calibrated in conventional units such as inches or centimeters.

SUMMARY OF THE INVENTION

Generally described, a method for controlling electrostatic precipitators and, particularly, for establishing control parameters in electrostatic precipitators, is provided. In accordance with the method, preferably embodied within a computer system, data indicative of performance characteristics of a first rapper is obtained and a first rapper lift value is calculated for the first rapper. Further, the present invention obtains data indicative of performance characteristics of a second rapper and calculates a second rapper lift value for the second rapper. The first rapper lift value is compared with the second rapper lift value and the performance characteristic data of the second rapper is adjusted so that the second rapper lift value approximately equals the first rapper lift value. This process is repeated for each rapper in the system so that each rapper has performance characteristics approximate the characteristics of the first rapper.

The present invention provides an improved method for controlling the rapping process used to clean the internal collection plates and discharge electrodes of electrostatic precipitators. The system obtains the performance characteristics of a first rapper and calculates a rapper lift value. The system then obtains performance characteristic data from two or more additional rappers (preferably each additional rapper in the system) and calculates rapper lift values for each of the rappers. The performance characteristics of each rapper are determined from data indicative of the peak current, current duration and rapper lift for each rapper. Finally, the system compares the rapper lift value of each additional rapper with the determined lift of the first rapper and adjusts the performance characteristics of each of the two or more additional rappers so that their rapper lift values are approximately equal to the performance characteristics of the first rapper and, in particular, so that the performance characteristics of all rappers are approximately equal to one another.

BRIEF DESCRIPTION OF THE DRAWINGS

In the accompanying drawings which form a part of the specification and are to be read in conjunction therewith, and in which like reference numerals are used to indicate like parts in the various views. The objectives and advantages of the present invention will become readily apparent to those skilled in the art from the following detailed description of the drawings, in which.

DETAILED DESCRIPTION OF THE INVENTION

Figure 1:
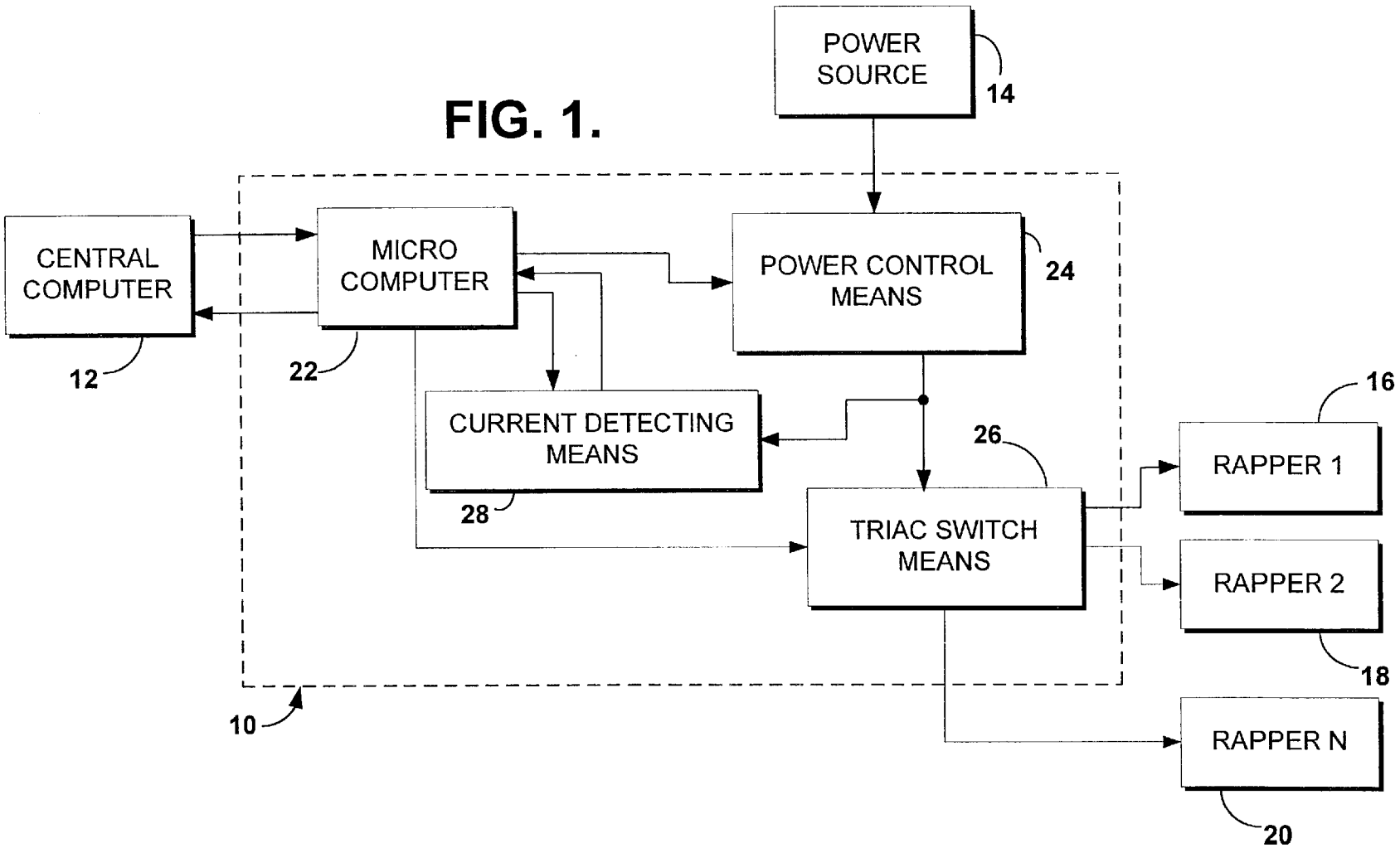
FIG. 1 is a block diagram illustrating a multiple rapper control constructed in accordance with a preferred embodiment of the invention.

A multiple rapper control system, embodying the principles of this invention, is shown in FIG. 1 of the drawings with the control block designated generally by the reference numeral 10. Control block 10 is connected to a central computer 12, a power source 14 and a plurality of rappers as schematically indicated by Rapper 116, Rapper 218, and Rapper N 20. More specifically, central computer 12 is bi-directionally connected to a microcomputer 22 which in turn is connected to both a power control means 24 and a TRIAC means 26. Power control means 24 is connected between a power source 14 and TRIAC switch means 26. A current detecting means 28 senses and measures the current between power control means 24 and TRIAC switch means 26 and is bi-directionally connected to microcomputer 22. Rapper 116, Rapper 218, and Rapper N 20 are each individually connected to a TRIAC within the TRIAC switch means 26. In other words, each rapper is connected to only one TRIAC and, conversely, each TRIAC is connected to only one rapper. The TRIAC may be typically characterized as a silicon bi-directional triode thyristor, such as T6420M of Motorola designated for a 600 volt rating for 40 amps.

Central computer 12 and microcomputer 22 typically include at least some form of computer-readable media. Computer-readable media can be any available media that can be accessed by the rapper control system 10. By way of example, and not limitation, computer-readable media may comprise computer storage media and communications media. Computer storage media includes volatile and non-volatile, removable and non-removable media implemented in any method or technology for storage of information such as computer-readable instructions, data structures, program modules or other data. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above would also be included within the scope of computer-readable media.

Additionally, the invention may be described in the general context of computer-executable instructions, such as program modules executed by one or more computers or other devices. Generally, program modules include routines, programs, objects, components, data structures, etc. that perform particular tasks or implement abstract data types. Typically, the functionality of the program modules may be combined or distributed as desired in various embodiments.

In operation, a look-up table including characteristics for each individual rapper is determined, entered and stored in central computer 12. The look-up table parameters comprise the location of each rapper, the rapper type (i.e. AC or DC voltage), the voltage level, the pre-set current characteristic of each rapper, open and short trip conditions for each rapper, the maximum duration of energization and the minimum time delay between energization cycles for each rapper. Microcomputer 22 is a slave to central computer 12 in that the microcomputer 22 waits for instruction from the central computer 12 before beginning operation. Upon receiving instruction from central computer 12 to energize Rapper 116, the microcomputer receives the location of Rapper 1, the voltage type and level of Rapper 1, the pre-set current characteristic for Rapper 1, the time duration of energization and the open and short trip conditions for Rapper 1. The pre-set current characteristic is stored in local memory at microcomputer 22 and then transmitted to power control means 24. The open and short trip conditions are also stored in local memory at the microcomputer 22. The location of Rapper 1 is translated at microcomputer 22 into a specific TRIAC switch and information to energize the appropriate TRIAC is transmitted to TRIAC switch means 26.

The rappers are operated by providing a pulse of controlled energy to the rapper coils. This pulse consists of a voltage and current and lasts for an adjustable duration. This duration is used to control rapper lift. The voltage is derived from the incoming line voltage and is substantially constant. The current varies as a function of resistivity of the coil, temperature, rapper characteristics, mounting, connections, and wiring. It can be shown that the peak rapper current is not constant for every half cycle of the rapper duration, but increases the first few half cycles until a final value is reached. This value becomes substantially constant when the hammer has lifted fully within the rapper coil. Once the final value is reached, increasing the duration to increase the rapper lift does not increase the peak current. Thus, adding a half cycle duration adds a half cycle with the same peak current.

In accordance with an aspect of the invention, an equation was derived to relate rapper lift, peak current, and duration, as follows:

$$\text{Rapper Lift Value}=(\text{Current}_{peak})^{Gain}*[(\text{Half Cycles On})/K]$$

Where:

Rapper Lift Value is a unitless number that can be calibrated in conventional units such as inches or centimeters.

$Current_{peak}$ is the peak rapper current measured during the duration. Peak current is not constant for every half cycle of the rapper duration. It increases until the hammer is fully within the rapper coil. The value that is used is the highest value of peak current recorded during the pulse.

Gain is an exponent that varies by rapper type and characteristic.

Half Cycles On is the duration of the rapper energization pulse measured in half cycles of incoming line current.

K is a constant determined by the line frequency. For 60 Hertz, K=120. For 50 Hertz, K=100.

The rapper lift value can be directly related to conventional units of linear measurement, such as inches or centimeters, with a high degree of accuracy. Peak current is raised to a power with the exponent Gain that illustrates why peak current has such a pronounced effect on rapper lift. Current has a much greater effect than duration. This explains why any phenomena that changes peak current, including the resistivity of the coil, temperature, rapper characteristics, mounting connections, and wiring, will have a substantial effect on rapper lift.

The rapper lift value equation was tested using a rapper of the type manufactured by BHA Group Holdings, Inc. of Kansas City, Mo. The rapper is a 120VDC electromagnetic gravity impact style, with a 20-pound hammer. The results are shown in Table 3.

TABLE 3

Rapper Lift Indicator Based Upon the Rapper Lift Value Equation.
Note: Measured with series impedance as indicated.

| Rapper Lift (inches) | Impedance (ohms) | Rapper Lift Value Equation Result (Amp Seconds) | Error In Rapper Lift (percent) |
|---|---|---|---|
| 5.76 | 0.0 | 260.9 | Baseline |
| 5.76 | 0.5 | 253.4 | −3 |
| 5.76 | 1.0 | 253.6 | −3 |
| 5.76 | 1.5 | 259.2 | −1 |
| 5.76 | 2.0 | 268.0 | 3 |

In order to obtain a baseline for comparison, the rapper was tested with a rapper lift of 5.76 inches. The rapper was physically close to the rapper control that provided an impedance of zero ohms between the rapper control and the rapper's coil. The rapper lift value equation was used which yielded a baseline for comparison of 260.9. Keeping the same rapper lift, and physically moving the rapper away from the rapper control, yielded the results shown in Table 3. Again, the distance is length of wiring, not distance from the rapper control, because it is the length of wiring that adds impedance. If there had been no error, there would be a rapper lift value of 260.9 for every case. The error in rapper lift measurement using the rapper lift equation is substantially less than prior art systems. Therefore, the rapper lift value equation can be used to provide a system to more accurately measure rapper lift than prior art systems that can be calibrated in conventional units such as inches or centimeters.

In the preferred embodiment, an operator would prepare the system for automatic regulation by selecting a rapper physically close to the rapper control and operating it at the desired lift. The computer would automatically store the peak current and duration for this rapper in memory. Likewise, the computer would use the rapper lift equation to calculate a rapper lift value and store this value in memory. Once stored, this rapper lift value is used to regulate the rapper lift for any rapper of the type selected. Any changes in peak current caused by the resistivity of the coil, temperature, rapper characteristics, mounting, connections, or wiring, are used to automatically adjust the duration by the rapper value equation. For example, if a rapper some distance away is operated, and a lower peak rapper current is measured, then the duration is increased according to the rapper lift value equation. Conversely, if a rapper closer to the rapper control is operated, and a greater peak rapper current is measured, then the duration is decreased according to the rapper lift value equation.

During normal operation, each time a rapper is operated, a rapper lift value is retrieved from memory and compared with the value just obtained. The duration is then adjusted according to the rapper lift value equation to closely and accurately regulate the rapper lift.

As stated, the preferred embodiment was tested using a rapper of the type manufactured by BHA Group Holdings, Inc. of Kansas City, Mo. The rapper is a 120VDC electromagnetic gravity impact style, with a 20-pound hammer. The results are shown in Table 4.

TABLE 4

Automatic Rapper Lift Regulation.
Note: Measured with series impedance as indicated.

| | MANUAL | | AUTOMATIC | |
|---|---|---|---|---|
| Impedance (ohms) | Rapper Lift (inches) | Error In Rapper Lift (percent) | Rapper Lift (inches) | Error In Rapper Lift (percent) |
| 0.0 | 5.76 | Baseline | 5.76 | Baseline |
| 0.5 | 3.36 | −42 | 6.24 | 8 |
| 1.0 | 1.82 | −68 | 6.34 | 10 |
| 1.5 | 1.06 | −82 | 5.86 | 2 |
| 2.0 | 0.48 | −92 | 5.28 | −8 |

In the Manual mode of operation, the rapper control was operated in the conventional manner used by prior art systems. An intensity or duration setting of 14.0 half cycles was used. The rapper was physically close to the rapper control, which provided an impedance of zero ohms between the rapper control and the rapper's coil. This yielded 5.76 inches of rapper lift which was used as a baseline for comparison. Keeping the same intensity or duration setting, and physically moving the rapper away from the rapper control, yielded the results shown in the MANUAL section of Table 4. If there had been no error, the rapper lift would have remained unchanged at 5.76 inches. The error, typical of prior art systems, was substantial.

In the Automatic mode of operation, the computer stored the baseline condition into memory and calculated a rapper lift value using the rapper lift value equation. The computer then used this value to automatically adjust the duration or intensity setting using the rapper lift value equation. Physically moving the rapper away from the rapper control yielded the results shown in the AUTOMATIC section of Table 4. If there had been no error, the rapper lift would have remained unchanged at 5.76 inches. The error in rapper lift was substantially less than that found in prior art system. Therefore, this system will more closely and accurately regulate rapper lift.

The exponent Gain provides for the calibration of different style rappers having different characteristics, using the same rapper lift value equation. The value of Gain can be found for any style of rapper by accurately measuring the rapper lift at a minimum of two points, and using the corresponding values of duration or intensity setting and peak current, to calculate Gain. In the preferred embodiment, for new rappers or rappers without known values of Gain, the software prompts the user to enter a measured lift at a minimum of two points to calibrate the system. The correct value of Gain is then automatically calculated and stored in the computer's memory for that rapper type. When automatic mode is selected, and that rapper is operated, the value of Gain is retrieved from the computer's memory.

It would be obvious to one skilled in the art that a plurality of gains or a plurality of equations could be used. As new rappers are developed, corresponding gains and equations could be installed in the software.

Figure 2:
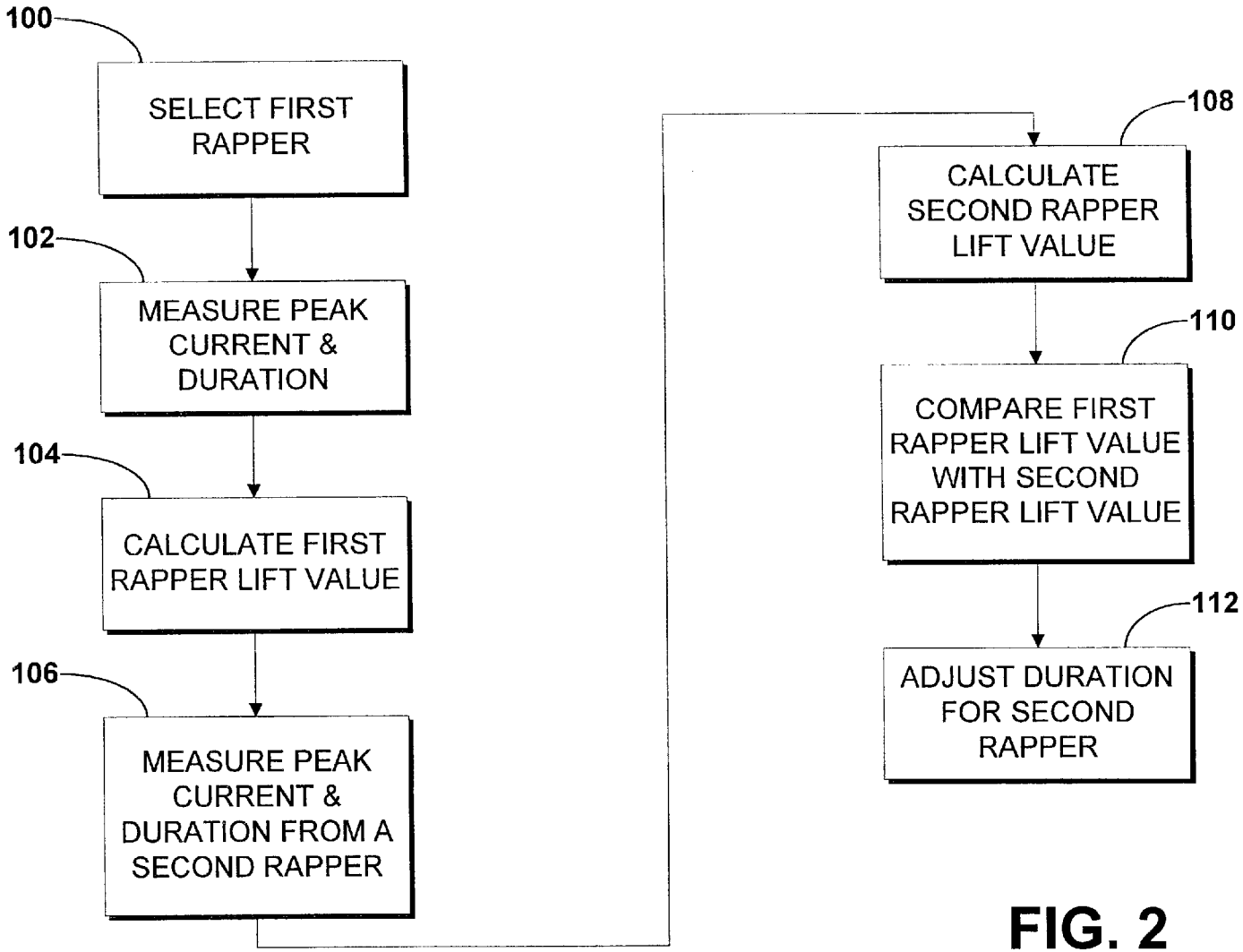
FIG. 2 is a flow diagram illustrating a preferred method for establishing control parameters for electrostatic precipitators

Referring now to FIG. 2, a preferred method for establishing control parameters for electrostatic precipitators is illustrated. At step 100, the system selects a first rapper that will be used as the control rapper to establish a baseline performance characteristic for controlling the remaining rappers in the system. At step 102, a desired lift is achieved and the peak current and energization duration is measured. A rapper lift value is calculated from the peak current and duration for the first rapper at step 104.

After a rapper lift value for the first rapper is calculated and stored on the system, it is used to regulate the rapper lift for any rapper of the type selected. At step 106, the peak current and energization duration from a second rapper is measured by the system and a second rapper lift value is calculated at step 108. The first rapper lift value is compared with the second rapper lift value at 110. To maintain an approximately constant rapper lift value among multiple rappers, the energization duration is adjusted according to the rapper lift value equation that will closely and accurately regulate the rapper lift. Changes in peak current between a first rapper and a second rapper may be caused by the resistivity of the coil temperature, rapper characteristics, mounting, connections, or wiring. For example, a first rapper located a certain distance away from the control system has an associated length of wiring between the control system and the rapper. A second rapper may be a further distance away from the control system thus having a longer wire to connect the control system to the rapper. This would create a difference in line impedance between the first rapper in the control system and the second rapper in the control system, thus a peak current detected at the second rapper would be lower than the peak current detected at the first rapper. When the lower peak rapper current is measured at the second rapper, the system increases the duration of the energization according to the rapper lift value equation above. This results in rapper lifts among multiple rappers being approximately the same, thereby resulting in a more efficient precipitator system.

From the foregoing it will be seen that this invention is one well adapted to attain all end and objects herein above set forth together with the other advantages which are obvious and which are inherent to the structure.

It will be understood that certain features and subcombinations are utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A method in a computer system of establishing control parameters in electrostatic precipitators, the method comprising:

obtaining data indicative of performance characteristics of a first rapper;

calculating a first rapper lift value for the first rapper;

obtaining data indicative of performance characteristics of a second rapper;

calculating a second rapper lift value for the second rapper;

comparing the first rapper lift value with the second rapper lift value; and adjusting the performance characteristic data of the second rapper so that the first rapper lift value approximately equals the second rapper lift value.

2. The method as recited in claim 1, wherein the rapper lift values are functions of the performance characteristics for each of the rappers.

3. The method as recited in claim 1, wherein the performance characteristic data include a peak current and an energization duration for each of the rappers.

4. The method as recited in claim 3, wherein the rapper lift values are functions of the peak current and the energization duration for each of the rappers.

5. The method as recited in claim 3, wherein the performance characteristic data include a gain for each of the rappers.

6. The method as recited in claim 5, wherein the rapper lift values are functions of the peak current, energization duration and gain for each of the rappers.

7. A method in a computer system for controlling electrostatic precipitators, the method comprising:

obtaining data indicative of performance characteristics of a first rapper, wherein said performance characteristic data includes peak current, duration and rapper lift;

obtaining data indicative of performance characteristics of two or more additional rappers, wherein said performance characteristic data includes peak current, duration and rapper lift; and processing the performance characteristic data for the first rapper with the performance characteristic data for each of the two or more additional rappers, wherein said obtaining first performance characteristic data step includes establishing a first rapper lift value, wherein said obtaining two or more performance characteristic data step includes establishing corresponding two or more rapper lift values for each of the two or more rappers.

8. The method as recited in claim 7, wherein said processing step includes comparing the performance characteristics of the first rapper with the performance characteristics of each of the two or more rappers.

9. The method as recited in claim 8, wherein said processing step includes adjusting the performance characteristic data for each of the two or more rappers so that the first rapper lift value approximately equals each of the rapper lift values for each of the two or more rappers.

10. A method in a computer system for calculating a gain associated with a rapper in an electrostatic precipitator, the method comprising:

obtaining data indicative of a first set of performance characteristic data at a first lift distance;

obtaining data indicative of a second set of performance characteristic data at a second lift distance; and calculating a gain using the first set of performance data and the second set of performance data.

11. The method as recited in claim 10, wherein said first performance characteristic data include a first peak current and a first duration.

12. The method as recited in claim 10, wherein said second performance characteristic data include a second peak current and a second duration.

13. A computer system for establishing control parameters in electrostatic precipitators, the system comprising:

a processor, wherein the processor obtains data indicative of performance characteristics of a first rapper and calculates a first rapper lift value for the first rapper wherein the processor obtains data indicative of performance characteristics of a second rapper, calculates a second rapper lift value for the second rapper, compares the first rapper lift value with the second rapper lift value and adjusts the performance characteristic data of the second rapper so that the first rapper lift value approximately equals the second rapper lift value.

14. The system as recited in claim 13, wherein the rapper lift values are functions of the performance characteristics for each of the rappers.

15. A method in a computer system for establishing a rapper lift value in electrostatic precipitators, the method comprising:

obtaining a peak current value;

obtaining a gain value, wherein the gain is a function of rapper type; obtaining a duration value;

obtaining a line frequency constant; and calculating the rapper lift value by multiplying the peak current value raised to the gain value with the duration value divided by the line frequency constant.

16. A computer-readable medium having computer-executable code embodied thereon for establishing control parameters in electrostatic precipitators, said computer-executable code comprising instructions that cause a computer to:

obtain data indicative of performance characteristics of a first rapper;

calculate a first rapper lift value for the first rapper;

obtain data indicative of performance characteristics of a second rapper;

calculate a second rapper lift value for the second rapper;

compare the first rapper lift value with the second rapper lift value; and adjust the performance characteristic data of the second rapper so that the first rapper lift value approximately equals the second rapper lift value.

17. A computer system for establishing control parameters in electrostatic precipitators, said computer system having a processor, a memory, and an operating environment, the computer system operable to:

obtain data indicative of performance characteristics of a first rapper;

calculate a first rapper lift value for the first rapper;

obtain data indicative of performance characteristics of a second rapper;

calculate a second rapper lift value for the second rapper;

compare the first rapper lift value with the second rapper lift value; and adjust the performance characteristic data of the second rapper so that the first rapper lift value approximately equals the second rapper lift value.

18. A computer-readable medium having computer-executable code embodied thereon for controlling electrostatic precipitators, said computer-executable code comprising instructions that cause a computer to:

obtain data indicative of performance characteristics of a first rapper, wherein said performance characteristic data includes peak current, duration and rapper lift;

obtain data indicative of performance characteristics of two or more additional rappers, wherein said performance characteristic data includes peak current, duration and rapper lift; and process the performance characteristic data for the first rapper with the performance characteristic data for each of the two or more additional rappers, wherein said instructions that cause the computer to obtain said performance characteristic data of a first rapper includes instructions that cause a computer to establish a first rapper lift value, and wherein said instructions that cause the computer to obtain performance characteristic data for two or more additional rappers includes instructions that cause a computer to establish corresponding two or more rapper lift values for each of the two or more rappers.

19. A computer system for controlling electrostatic precipitators, said computer system having a processor, a memory, and an operating environment, the computer system operable to:

obtain data indicative of performance characteristics of a first rapper, wherein said performance characteristic data includes peak current, duration and rapper lift;

obtain data indicative of performance characteristics of two or more additional rappers, wherein said performance characteristic data includes peak current, duration and rapper lift; and process the performance characteristic data for the first rapper with the performance characteristic data for each of the two or more additional rappers, wherein obtaining said performance characteristic data of a first rapper includes establishing a first rapper lift value, wherein obtaining said performance characteristic data of two or more rappers includes establishing corresponding two or more rapper lift values for each of the two or more rappers.

20. A computer-readable medium having computer-executable code embodied thereon for calculating a gain associated with a rapper in an electrostatic precipitator, said computer-executable code comprising instructions that cause a computer to:

obtain data indicative of a first set of performance characteristic data at a first lift distance;

obtain data indicative of a second set of performance characteristic data at a second lift distance; and calculate a gain using the first set of performance data and the second set of performance data.

21. A computer system for calculating a gain associated with a rapper in an electrostatic precipitator, said computer system having a processor, a memory, and an operating environment, said computer system operable to:

obtain data indicative of a first set of performance characteristic data at a first lift distance;

obtain data indicative of a second set of performance characteristic data at a second lift distance; and calculate a gain using the first set of performance data and the second set of performance data.

* * * * *